US010197278B2

(12) United States Patent
Bloom et al.

(10) Patent No.: US 10,197,278 B2
(45) Date of Patent: Feb. 5, 2019

(54) COMBUSTOR ASSEMBLY FOR A TURBINE ENGINE

(71) Applicant: General Electric Company, Schnectady, NY (US)

(72) Inventors: Nicholas John Bloom, Maineville, OH (US); Daniel Kirtley, Blue Ash, OH (US); Michael Alan Stieg, Cincinnati, OH (US); Brian Christopher Towle, Leawood, KS (US); Chad Holden Sutton, Nashville, TN (US)

(73) Assignee: General Electric Company, Schenectady, NY (US)

( * ) Notice: Subject to any disclaimer, the term of this patent is extended or adjusted under 35 U.S.C. 154(b) by 189 days.

(21) Appl. No.: 14/842,883

(22) Filed: Sep. 2, 2015

(65) Prior Publication Data

US 2017/0059160 A1 Mar. 2, 2017

(51) Int. Cl.

| | |
|---|---|
| ***F23R 3/00*** | (2006.01) |
| ***F23R 3/50*** | (2006.01) |
| ***F23R 3/60*** | (2006.01) |

(52) U.S. Cl.

CPC ..... *F23R 3/007* (2013.01); *F23R 3/50* (2013.01); *F23R 3/60* (2013.01); *F23R 2900/00012* (2013.01)

(58) Field of Classification Search

CPC .. F23R 3/60; F23R 2900/00012; F23R 3/002; F23R 3/007; F23R 2900/00017; F02C 7/28; F02C 7/20; F05D 2240/55

See application file for complete search history.

(56) References Cited

U.S. PATENT DOCUMENTS

| | | | |
|---|---|---|---|
| 3,604,716 | A | 9/1971 | Webert |
| 5,330,321 | A | 7/1994 | Roberts et al. |

(Continued)

FOREIGN PATENT DOCUMENTS

| | | | |
|---|---|---|---|
| CN | 1590850 | A | 3/2005 |
| CN | 1828140 | A | 9/2006 |

(Continued)

OTHER PUBLICATIONS

MatWeb, MetalTek MARM247® CentriVac Nickel Cobalt Based Alloy.*

(Continued)

*Primary Examiner* — Craig Kim
*Assistant Examiner* — Edwin Kang
(74) *Attorney, Agent, or Firm* — General Electric Company; William Andes

(57) ABSTRACT

A combustor assembly for a gas turbine engine is provided. The combustor assembly includes a liner at least partially defining a combustion chamber and extending between an aft end a forward end generally along an axial direction. The combustor assembly also includes an annular dome including an enclosed surface defining a slot for receipt of the forward end of the liner. A cap is positioned at the forward end of the liner and at least partially positioned within the slot defined by the enclosed surface of the annular dome. The cap includes a surface configured to contact at least one of the enclosed surface of the annular dome and the forward end of the liner. Such a configuration may form a substantially airtight seal between the forward end of the liner and the annular dome despite a relative thermal expansion between the components.

13 Claims, 4 Drawing Sheets

(56) References Cited

U.S. PATENT DOCUMENTS

| | | | | |
|---|---|---|---|---|
| 5,680,767 | A | 10/1997 | Lee et al. | |
| 5,996,335 | A | 12/1999 | Ebel | |
| 6,234,755 | B1 | 5/2001 | Bunker et al. | |
| 6,383,602 | B1 | 5/2002 | Fric et al. | |
| 6,397,603 | B1 | 6/2002 | Edmondson et al. | |
| 6,435,514 | B1 | 8/2002 | Aksit et al. | |
| 6,513,330 | B1 * | 2/2003 | Rice | F04D 29/542 60/751 |
| 6,655,148 | B2 | 12/2003 | Calvez et al. | |
| 6,775,985 | B2 * | 8/2004 | Mitchell | F23R 3/007 60/772 |
| 6,840,519 | B2 | 1/2005 | Dinc et al. | |
| 6,904,757 | B2 | 6/2005 | Mitchell et al. | |
| 7,328,580 | B2 | 2/2008 | Lee et al. | |
| 7,347,425 | B2 * | 3/2008 | James | F01D 11/005 277/644 |
| 7,572,099 | B2 | 8/2009 | Addis | |
| 7,849,696 | B2 | 12/2010 | De Sousa et al. | |
| 7,997,867 | B1 | 8/2011 | Shih et al. | |
| 8,057,179 | B1 | 11/2011 | Liang | |
| 8,057,181 | B1 | 11/2011 | Liang | |
| 8,141,370 | B2 | 3/2012 | Bulman et al. | |
| 8,556,531 | B1 | 10/2013 | Bird et al. | |
| 8,572,981 | B2 | 11/2013 | Bunker | |
| 8,607,577 | B2 | 12/2013 | Ruberte et al. | |
| 8,689,586 | B2 | 4/2014 | Hirayama et al. | |
| 8,739,547 | B2 | 6/2014 | Jarmon et al. | |
| 8,834,056 | B2 | 9/2014 | Keith et al. | |
| 8,863,527 | B2 | 10/2014 | Holcomb et al. | |
| 8,863,528 | B2 * | 10/2014 | Shi | F23R 3/007 60/753 |
| 9,097,211 | B2 | 8/2015 | Martinez et al. | |
| 9,127,565 | B2 | 9/2015 | Keller et al. | |
| 9,423,129 | B2 | 8/2016 | Graves et al. | |
| 9,976,746 | B2 | 5/2018 | Bloom et al. | |
| 2002/0108378 | A1 | 8/2002 | Ariyoshi et al. | |
| 2004/0118122 | A1 | 6/2004 | Mitchell et al. | |
| 2004/0134198 | A1 * | 7/2004 | Mitchell | F23R 3/007 60/796 |
| 2005/0135931 | A1 | 6/2005 | Nakamata et al. | |
| 2006/0038358 | A1 * | 2/2006 | James | F01D 11/005 277/641 |
| 2008/0286090 | A1 | 11/2008 | Okita | |
| 2011/0097191 | A1 | 4/2011 | Bunker | |
| 2011/0271684 | A1 | 11/2011 | Corsmeier et al. | |
| 2011/0293423 | A1 | 12/2011 | Bunker et al. | |
| 2011/0305583 | A1 | 12/2011 | Lee et al. | |
| 2013/0175015 | A1 | 7/2013 | Tanaka et al. | |
| 2013/0205787 | A1 | 8/2013 | Zelesky et al. | |
| 2013/0205791 | A1 | 8/2013 | Mongillo et al. | |
| 2013/0205792 | A1 | 8/2013 | Gleiner et al. | |
| 2013/0209229 | A1 | 8/2013 | Xu et al. | |
| 2013/0209236 | A1 | 8/2013 | Xu | |
| 2013/0209269 | A1 | 8/2013 | Gleiner et al. | |
| 2014/0190167 | A1 * | 7/2014 | Shi | F23R 3/007 60/737 |
| 2015/0330633 | A1 | 11/2015 | Graves et al. | |
| 2016/0017738 | A1 * | 1/2016 | Rogers | F02C 7/28 415/214.1 |
| 2016/0047549 | A1 | 2/2016 | Landwehr et al. | |
| 2016/0215980 | A1 | 7/2016 | Chang | |
| 2016/0215981 | A1 | 7/2016 | Dery | |
| 2016/0265389 | A1 | 9/2016 | Jarmon | |
| 2017/0058778 | A1 | 3/2017 | Bloom et al. | |
| 2017/0059166 | A1 | 3/2017 | Bloom et al. | |

FOREIGN PATENT DOCUMENTS

| | | | |
|---|---|---|---|
| CN | 103162311 | A | 6/2013 |
| CN | 204200279 | U | 3/2015 |
| DE | 102013220482 | B3 | 4/2015 |
| EP | 1719949 | A2 | 11/2006 |
| EP | 1777461 | A2 | 4/2007 |
| FR | 3004518 | A1 | 10/2014 |
| FR | 3022480 | A1 | 12/2015 |
| JP | 2002221322 | A | 8/2002 |
| WO | 2013188645 | A2 | 12/2013 |
| WO | 2015038274 | A1 | 3/2015 |

OTHER PUBLICATIONS

European Search Report and Opinion issued in connection with corresponding EP Application No. 16185947.5 dated Feb. 1, 2017.
EP Search Report dated Jan. 26, 2017 issued in connection with related Application No. 16185942.6.
GE Related Case Form.
Machine translation and Japanese Office Action issued in connection with corresponding JP Application No. 2016162308 dated Aug. 29, 2017.
Machine Translation and First Office Action and Search issued in connection with corresponding CN Application No. 201610776933.9 dated Jul. 30, 2018.

* cited by examiner

COMBUSTOR ASSEMBLY FOR A TURBINE ENGINE

FIELD OF THE INVENTION

The present subject matter relates generally to a gas turbine engine, or more particularly to a combustor assembly for a gas turbine engine.

BACKGROUND OF THE INVENTION

A gas turbine engine generally includes a fan and a core arranged in flow communication with one another. Additionally, the core of the gas turbine engine general includes, in serial flow order, a compressor section, a combustion section, a turbine section, and an exhaust section. In operation, air is provided from the fan to an inlet of the compressor section where one or more axial compressors progressively compress the air until it reaches the combustion section. Fuel is mixed with the compressed air and burned within the combustion section to provide combustion gases. The combustion gases are routed from the combustion section to the turbine section. The flow of combustion gasses through the turbine section drives the turbine section and is then routed through the exhaust section, e.g., to atmosphere.

More commonly, non-traditional high temperature materials, such as ceramic matrix composite (CMC) materials, are being used as structural components within gas turbine engines. For example, given an ability for CMC materials to withstand relatively extreme temperatures, there is particular interest in replacing components within the combustion section of the gas turbine engine with CMC materials. More particularly, an inner liner and an outer liner of gas turbine engines are more commonly being formed of CMC materials.

However, certain gas turbine engines have had problems accommodating certain mechanical properties of the CMC materials incorporated therein. For example, CMC materials have different coefficients of thermal expansion than the traditional metal materials. Accordingly, coupling the CMC materials to the traditional metal materials can be problematic. For example, special care must be taken in attaching the inner liner and outer liner to a metallic inner dome structure and a metallic outer dome structure, respectively.

Moreover, certain gas turbine engines having the inner and outer liners formed of CMC materials have difficulty in controlling an amount of high-pressure air that flows through one or more connection points—e.g., between the inner liner and inner dome structure and the outer liner and outer dome structure—into a combustion chamber at least partially defined by the inner and outer liners.

Accordingly, a combustor assembly having one more features allowing for a CMC liner to be attached to a respective metallic dome structure at an attachment point while controlling an amount of airflow therethrough would be useful. More particularly, a combustor assembly having one more features allowing for a CMC liner to be attached to a respective metallic dome structure at an attachment point while controlling an amount of airflow therethrough and allowing for relative thermal expansion would be particularly beneficial.

BRIEF DESCRIPTION OF THE INVENTION

Aspects and advantages of the invention will be set forth in part in the following description, or may be obvious from the description, or may be learned through practice of the invention.

In one exemplary embodiment of the present disclosure, a combustor assembly for a gas turbine engine is provided. The combustor assembly defines an axial direction and includes a liner at least partially defining a combustion chamber. The liner extends between an aft end and a forward end generally along the axial direction. The combustor assembly also includes an annular dome including an enclosed surface defining a slot for receipt of the forward end of the liner. The combustor assembly also includes a cap positioned at the forward end of the liner and at least partially positioned within the slot defined by the enclosed surface of the annular dome. The cap includes a surface configured to contact at least one of the enclosed surface of the annular dome or the forward end of the liner.

In another exemplary embodiment of the present disclosure, a cap assembly for a liner of a gas turbine engine combustor assembly is provided. The cap assembly includes a first arm and a second arm extending substantially parallel with the first arm. The first and second arms together define an opening for receipt of a forward end of the liner. The cap assembly also includes a base extending between the first and second arms and defining an inside surface and an outside surface. The cap assembly also includes a resilient member positioned adjacent to the inside surface of the base for pressing the base away from the forward end of the liner and forming a seal between the base and the forward end of the liner when the cap assembly is positioned over the forward end of the liner.

In still another exemplary embodiment of the present disclosure, a gas turbine engine defining an axial direction is provided. The gas turbine engine includes a compressor section, a turbine section mechanically coupled to the compressor section through a shaft, and a combustor assembly disposed between the compressor section and the turbine section. The combustor assembly includes a liner at least partially defining a combustion chamber and extending between an aft end and a forward end generally along the axial direction. The combustor assembly also includes an annular dome including an enclosed surface defining a slot for receipt of the forward end of the liner. The combustor assembly also includes a cap positioned at the forward end of the liner and at least partially positioned within the slot defined by the enclosed surface of the annular dome. The cap includes a surface configured to contact at least one of the enclosed surface of the annular dome or the forward end of the liner.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
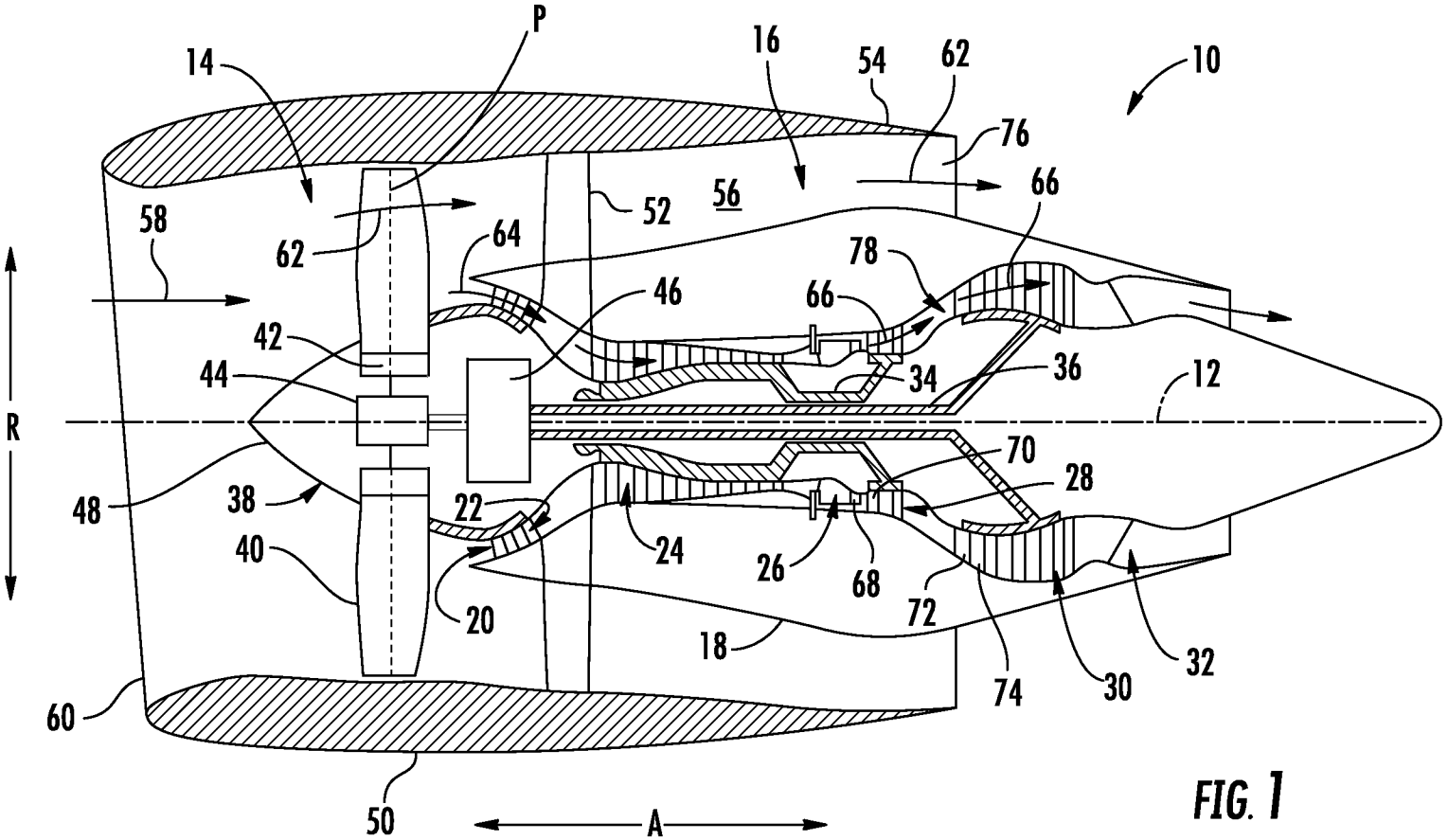
FIG. 1 is a schematic cross-sectional view of an exemplary gas turbine engine according to various embodiments of the present subject matter.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Referring now to the drawings, wherein identical numerals indicate the same elements throughout the figures, FIG. 1 is a schematic cross-sectional view of a gas turbine engine in accordance with an exemplary embodiment of the present disclosure. More particularly, for the embodiment of FIG. 1, the gas turbine engine is a high-bypass turbofan jet engine 10, referred to herein as "turbofan engine 10." As shown in FIG. 1, the turbofan engine 10 defines an axial direction A (extending parallel to a longitudinal centerline 12 provided for reference) and a radial direction R. In general, the turbofan 10 includes a fan section 14 and a core turbine engine 16 disposed downstream from the fan section 14.

The exemplary core turbine engine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustion section 26; a turbine section including a high pressure (HP) turbine 28 and a low pressure (LP) turbine 30; and a jet exhaust nozzle section 32. A high pressure (HP) shaft or spool 34 drivingly connects the HP turbine 28 to the HP compressor 24. A low pressure (LP) shaft or spool 36 drivingly connects the LP turbine 30 to the LP compressor 22.

For the embodiment depicted, the fan section 14 includes a variable pitch fan 38 having a plurality of fan blades 40 coupled to a disk 42 in a spaced apart manner. As depicted, the fan blades 40 extend outwardly from disk 42 generally along the radial direction R. Each fan blade 40 is rotatable relative to the disk 42 about a pitch axis P by virtue of the fan blades 40 being operatively coupled to a suitable actuation member 44 configured to collectively vary the pitch of the fan blades 40 in unison. The fan blades 40, disk 42, and actuation member 44 are together rotatable about the longitudinal axis 12 by LP shaft 36 across a power gear box 46. The power gear box 46 includes a plurality of gears for stepping down the rotational speed of the LP shaft 36 to a more efficient rotational fan speed.

Referring still to the exemplary embodiment of FIG. 1, the disk 42 is covered by rotatable front nacelle 48 aerodynamically contoured to promote an airflow through the plurality of fan blades 40. Additionally, the exemplary fan section 14 includes an annular fan casing or outer nacelle 50 that circumferentially surrounds the fan 38 and/or at least a portion of the core turbine engine 16. It should be appreciated that the nacelle 50 may be configured to be supported relative to the core turbine engine 16 by a plurality of circumferentially-spaced outlet guide vanes 52. Moreover, a downstream section 54 of the nacelle 50 may extend over an outer portion of the core turbine engine 16 so as to define a bypass airflow passage 56 therebetween.

During operation of the turbofan engine 10, a volume of air 58 enters the turbofan 10 through an associated inlet 60 of the nacelle 50 and/or fan section 14. As the volume of air 58 passes across the fan blades 40, a first portion of the air 58 as indicated by arrows 62 is directed or routed into the bypass airflow passage 56 and a second portion of the air 58 as indicated by arrow 64 is directed or routed into the LP compressor 22. The ratio between the first portion of air 62 and the second portion of air 64 is commonly known as a bypass ratio. The pressure of the second portion of air 64 is then increased as it is routed through the high pressure (HP) compressor 24 and into the combustion section 26, where it is mixed with fuel and burned to provide combustion gases 66.

The combustion gases 66 are routed through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft or spool 34, thus causing the HP shaft or spool 34 to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft or spool 36, thus causing the LP shaft or spool 36 to rotate, thereby supporting operation of the LP compressor 22 and/or rotation of the fan 38.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the turbofan 10, also providing propulsive thrust. The HP turbine 28, the LP turbine 30, and the jet exhaust nozzle section 32 at least partially define a hot gas path 78 for routing the combustion gases 66 through the core turbine engine 16.

Figure 2:
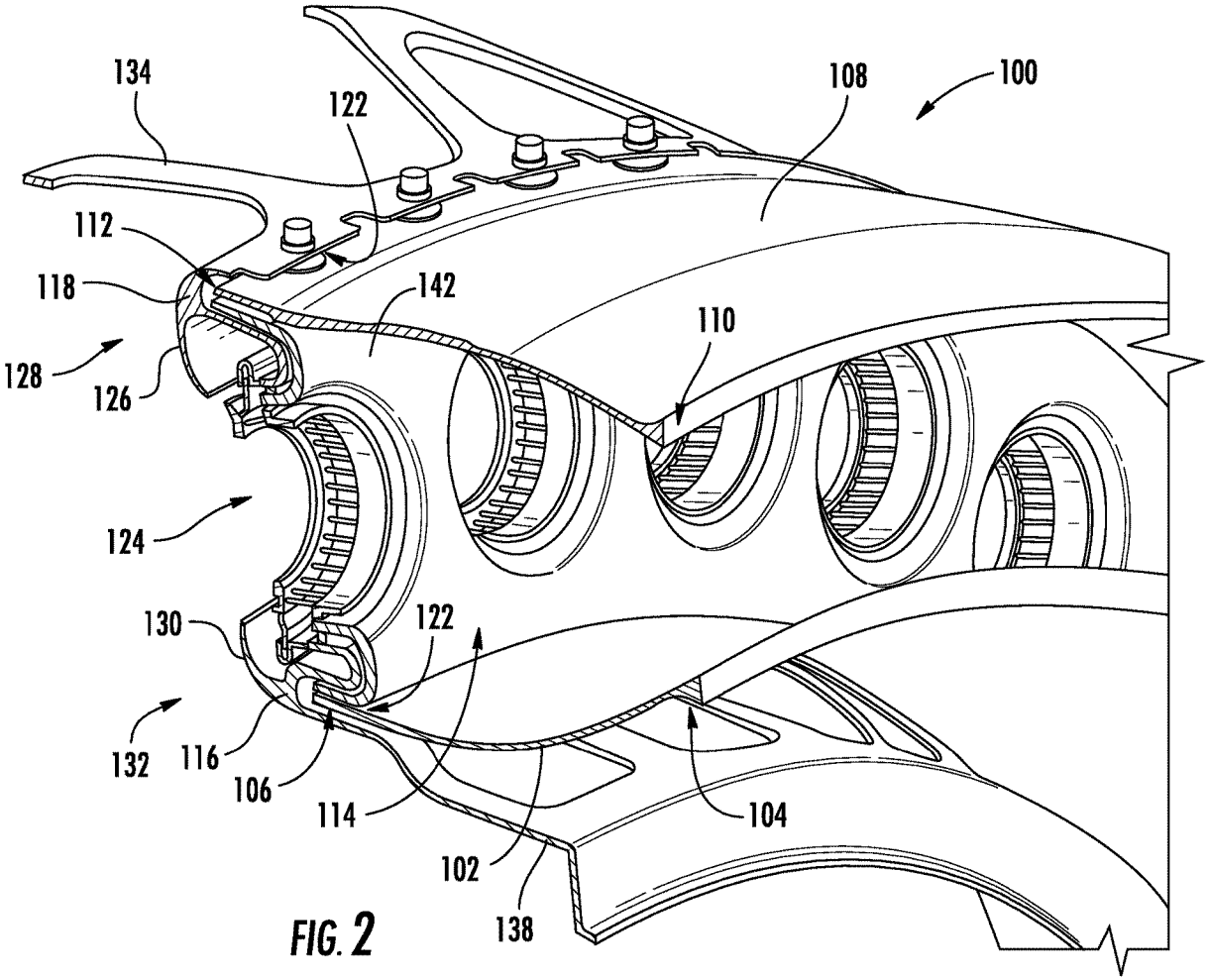
FIG. 2 is a perspective, cross-sectional view of a combustor assembly in accordance with an exemplary embodiment of the present disclosure.
Figure 3:
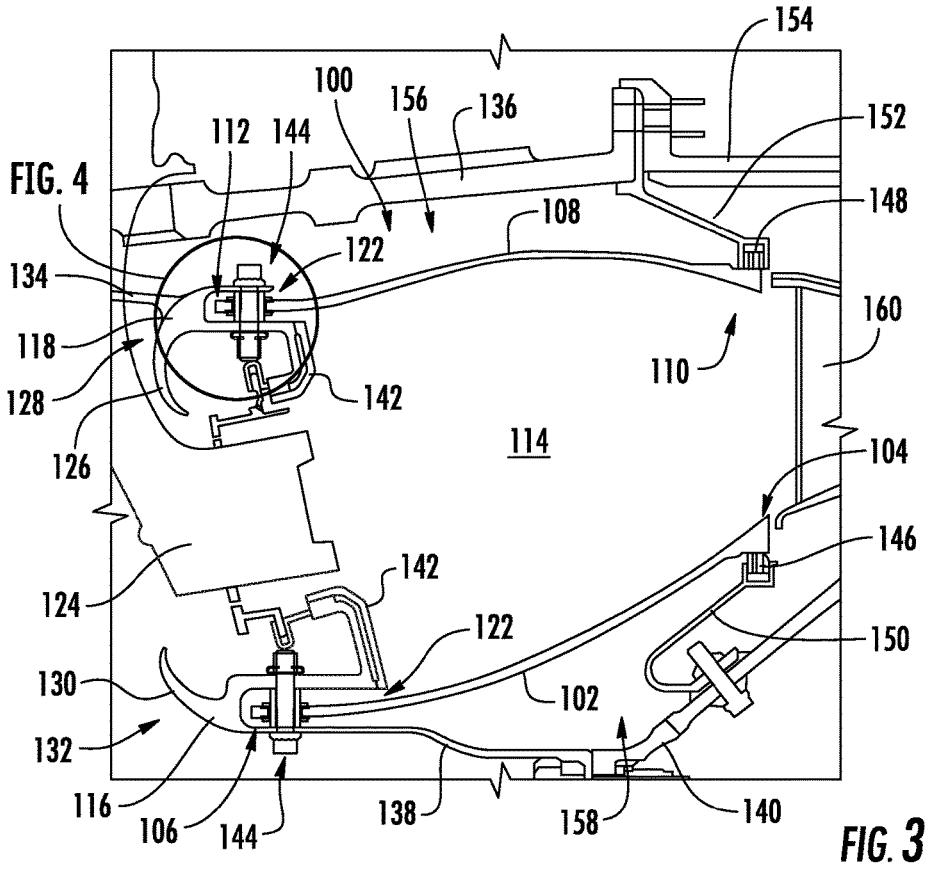
FIG. 3 is a schematic, cross-sectional view of the exemplary combustor assembly of FIG. 2.

Referring now to FIGS. 2 and 3, close-up cross-sectional views are provided of the combustion section 26 of the exemplary turbofan engine 10 of FIG. 1. More particularly, FIG. 2 provides a perspective, cross-sectional view of a combustor assembly 100, which may be positioned in the combustion section 26 of the exemplary turbofan engine 10 of FIG. 1, in accordance with an exemplary embodiment of the present disclosure, and FIG. 3 provides a side, cross-sectional view of the exemplary combustor assembly 100 of FIG. 2. Notably, FIG. 2 provides a perspective, cross-sectional view of the combustor assembly 100 having an outer combustor casing 136 removed for clarity.

As shown, the combustor assembly 100 generally includes an inner liner 102 extending between and aft end 104 and a forward end 106 generally along the axial direction A, as well as an outer liner 108 also extending between and aft end 110 and a forward end 112 generally along the axial direction A. The inner and outer liners 102, 108 together at least partially define a combustion chamber 114 therebetween. The inner and outer liners 102, 108 are each attached to an annular dome. More particularly, the combustor assembly 100 includes an inner annular dome 116 attached to the forward end 106 of the inner liner 102 and an outer annular dome 118 attached to the forward end 112 of the outer liner 108. As will be discussed in greater detail below, the inner and outer annular domes 116, 118 each include an enclosed surface 120 defining a slot 122 for receipt of the forward ends 106, 112 of the respective inner and outer liners 102, 108.

The combustor assembly 100 further includes a plurality of fuel air mixers 126 (FIG. 3) spaced along a circumferential direction C within the outer dome 118. More particularly, the plurality of fuel air mixers 126 are disposed between the outer dome 118 and the inner dome 116 along the radial direction R. Compressed air from the compressor section of the turbofan engine 10 flows into or through the fuel air mixers 126, where the compressed air is mixed with fuel and ignited to create the combustion gases 66 within the combustion chamber 114. The inner and outer domes 116, 118 are configured to assist in providing such a flow of compressed air from the compressor section into or through the fuel air mixers 126. For example, the outer dome 118 includes an outer cowl 126 at a forward end 128 and the inner dome 116 similarly includes an inner cowl 130 at a forward end 132. The outer cowl 126 and inner cowl 130 may assist in directing the flow of compressed air from the compressor section 26 into or through one or more of the fuel air mixers 126.

Moreover, the inner and outer domes 116, 118 each include attachment portions configured to assist in mounting the combustor assembly 100 within the turbofan engine 10. For example, the outer dome 118 includes an attachment extension 134 configured to be mounted to an outer combustor casing 136 (FIG. 3) and the inner dome 116 includes a similar attachment extension 138 configured to attach to an annular support member 140 (FIG. 3) within the turbofan engine 10. In certain exemplary embodiments, the inner dome 116 may be formed integrally as a single annular component, and similarly, the outer dome 118 may also be formed integrally as a single annular component. It should be appreciated, however, that in other exemplary embodiments, the inner dome 116 and/or the outer dome 118 may alternatively be formed by one or more components joined in any suitable manner. For example, with reference to the outer dome 118, in certain exemplary embodiments, the outer cowl 126 may be formed separately from the outer dome 118 and attached to the forward end 128 of the outer dome 118 using, e.g., a welding process. Similarly, the attachment extension 134 may also be formed separately from the outer dome 118 and attached to the forward end 128 of the outer dome 118 using, e.g., a welding process. Additionally, or alternatively, the inner dome 116 may have a similar configuration.

Referring still to FIGS. 2 and 3, the exemplary combustor assembly 100 further includes a plurality of heat shields 142 positioned around each fuel air mixer 124, arrange circumferentially. The heat shields 142, for the embodiment depicted, are attached to and extend between the outer dome 118 and the inner dome 116. The heat shields 142 are configured to protect certain components of the turbofan engine 10 from the relatively extreme temperatures of the combustion chamber 114.

For the embodiment depicted, the inner liner 102 and outer liner 108 are each comprised of a ceramic matrix composite (CMC) material, which is a non-metallic material having high temperature capability. Exemplary CMC materials utilized for such liners 102, 108 may include silicon carbide, silicon, silica or alumina matrix materials and combinations thereof. Ceramic fibers may be embedded within the matrix, such as oxidation stable reinforcing fibers including monofilaments like sapphire and silicon carbide (e.g., Textron's SCS-6), as well as rovings and yarn including silicon carbide (e.g., Nippon Carbon's NICALON®, Ube Industries' TYRANNO®, and Dow Corning's SYLRAMIC®), alumina silicates (e.g., Nextel's 440 and 480), and chopped whiskers and fibers (e.g., Nextel's 440 and SAFFIL®), and optionally ceramic particles (e.g., oxides of Si, Al, Zr, Y and combinations thereof) and inorganic fillers (e.g., pyrophyllite, wollastonite, mica, talc, kyanite and montmorillonite). CMC materials may have coefficients of thermal expansion in the range of about $1.3\times10^{-6}$ in/in/° F. to about $3.5\times10^{-6}$ in/in/° F. in a temperature of approximately 1000-1200° F.

By contrast, the inner dome 116 and outer dome 118, including the inner cowl 130 and outer cowl 126, respectively, may be formed of a metal, such as a nickel-based superalloy (having a coefficient of thermal expansion of about $8.3\text{-}8.5\times10^{-6}$ in/in/° F. in a temperature of approximately 1000-1200° F.) or cobalt-based superalloy (having a coefficient of thermal expansion of about $7.8\text{-}8.1\times10^{-6}$ in/in/° F. in a temperature of approximately 1000-1200° F.). Thus, the inner and outer liners 102, 108 may be better able to handle the extreme temperature environment presented in the combustion chamber 114. However, attaching the inner and outer liners 102, 108 to the respective inner and outer domes 116, 118 presents a problem due to the differing mechanical characteristics of the components. Accordingly, as will be discussed below, a plurality of specially designed mounting assemblies 144 are utilized to attach the forward end 106 of the inner liner 102 to the inner dome 116, as well as to attach the forward end 112 of the outer liner 108 to the outer dome 118. The mounting assemblies 144 are configured to accommodate the relative thermal expansion between the inner and outer domes 116, 118 and the inner and outer liners 102, 108, respectively, along the radial direction R.

Referring particularly to FIG. 3, at the aft end 104 of the inner liner 102 and at the aft end 110 of the outer liner 108, the combustor assembly 100 includes an inner piston ring 146 and an outer piston ring 148, respectively. The inner piston ring 146 is attached to an inner piston ring holder 150 extending from and attached to an interior casing (which for the embodiment depicted is the annular support member 140). Similarly, the outer piston ring 148 is attached to an outer piston ring holder 152 extending from and attached to an outer casing (which for the embodiment depicted includes the outer combustor casing 136 and an outer turbine casing 154). The inner piston ring holder 150 and the outer piston ring holder 152 are configured to accommodate an expansion of the inner liner 102 and the outer liner 108 generally along the axial direction A, as well as generally along the radial direction R.

As will be discussed in greater detail below, the above configuration may allow for the relative thermal expansions of the inner and outer liners 102, 108, formed of a CMC material, and the inner and outer domes 116, 118, formed of a metal material, while controlling an airflow of relatively high pressure compressed air from the compressor section 26 into the relatively low pressure combustion chamber 114. More particularly, such a configuration may control an airflow of relatively high pressure compressed air in a high pressure plenum 156 defined between the outer liner 108 and the outer combustor casing 136 into the relatively low pressure combustion chamber 114, as well as an airflow of relatively high pressure compressed air in an inner passage 158 positioned radially inward from the inner liner 102 into the relatively low pressure combustion chamber 114.

Referring particularly to FIG. 3, and as is discussed above, the combustion gases 66 flow from the combustion chamber 114 into and through the turbine section of the turbofan engine 10 where a portion of thermal and/or kinetic energy from the combustion gases 66 is extracted via sequential stages of turbine stator vanes and turbine rotor blades. A stage 1 turbine blade 160 is depicted schematically in FIG. 3, aft of the compressor assembly 100.

Figure 4:
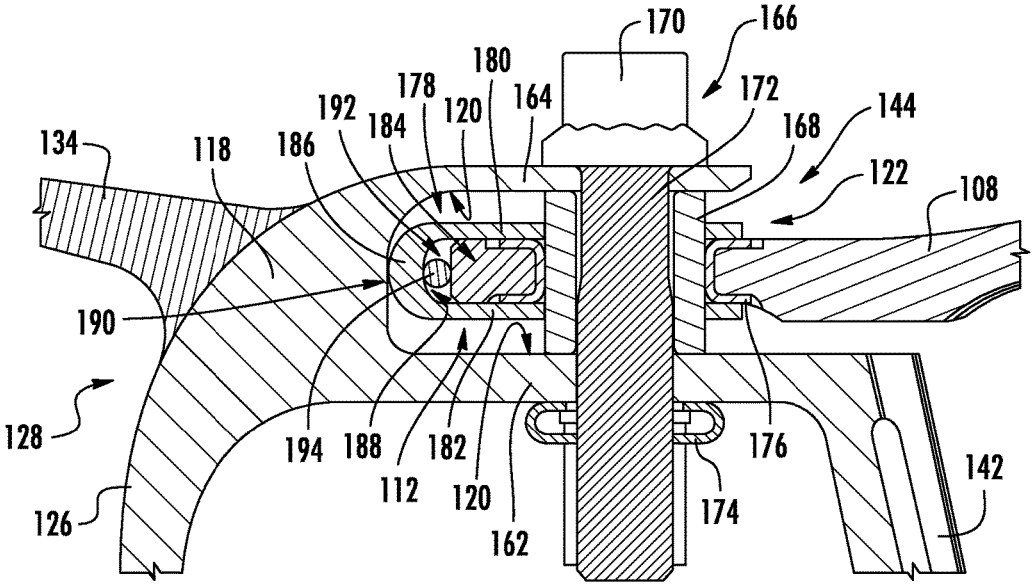
FIG. 4 is a close up, cross-sectional view of an attachment point of the exemplary combustor assembly of FIG. 2, where a forward end of an outer liner is attached to an outer annular dome.

Referring now particularly to FIG. 4, a close up, cross-sectional view of an attachment point where the forward end 112 of the outer liner 108 is attached to the outer annular dome 118 is depicted, taken along Circle 4-4 of FIG. 3.

As stated, to allow for a relative thermal expansion of the outer liner 108 and outer dome 118, the mounting assemblies 144 are provided extending through the slots 122 defined by the enclosed surfaces 120 of the inner and outer annular domes 116, 118. More particularly, referring specifically to the outer dome 118 and forward end 112 of the outer liner 108 depicted in FIG. 4, the outer dome 118 includes a base plate 162 and a yoke 164. The base plate 162 and the yoke 164 each extend substantially parallel to one another, which for the embodiment depicted is a direction substantially parallel to the axial direction A of the turbofan engine 10. Additionally, in certain exemplary embodiments, the yoke 164 may extend circumferentially with the outer dome 118, tracking the base plate 162. With such a configuration, the slot 122 may be considered an annular slot. However, in other embodiments, the yoke 164 may include a plurality of circumferentially spaced tabs (see FIG. 2), each of the individual tabs of the yoke 164 defining individual segmented portions of the slot 122 with the base plate 162.

The exemplary mounting assembly 144 depicted extends through the yoke 164 of the outer dome 118, through the forward end 112 of the outer liner 108 (positioned in the slot 122 defined by the outer dome 118), and through the base plate 162 of the outer dome 118. For the embodiment depicted, the mounting assembly 144 includes a pin 166 and a bushing 168. The pin 166 includes a head 170 and a body 172, the body 172 extending through the yoke 164, the forward end 112 of the outer liner 108 (positioned in the slot 122), and the base plate 162. A nut 174 is attached to a distal end of the body 172 of the pin 166. In certain exemplary embodiments, the pin 166 may be configured as a bolt and the nut 174 may be rotatably engaged with the pin 166 for tightening the mounting assembly 144. Alternatively, however, in other exemplary embodiments, the pen 166 and nut 174 may have any other suitable configuration. For example, in other exemplary embodiments, the pin 166 may include a body 172 defining a substantially smooth cylindrical shape and the nut 174 may be configured as a clip.

Additionally, the bushing 168 is generally cylindrical in shape and positioned around the body 172 of the pin 166 within the slot 122. The bushing 168 is pressed between the yoke 164 and the base plate 162. Moreover, for the embodiment depicted, the mounting assembly 144 includes a metal grommet 176 positioned around the bushing 168 within an opening defined in the forward end 112 of the outer liner 108. The metal grommet 176 may reduce an amount of wear on the forward end 112 of the outer liner 108 as the outer liner 108 moves inwardly and outwardly generally along the radial direction R relative to the outer dome 118. More particularly, the metal grommet 176 may reduce an amount of wear around an opening 177 in the outer liner through which the mounting assembly 144 extends.

Referring still to FIG. 4, the exemplary combustor assembly 100 further includes a cap 178 positioned at the forward end 112 of the outer liner 108. More particularly, for the embodiment depicted, the cap 178 is positioned over the forward end 112 of the outer liner 108 and at least partially within the slot 122 of the outer dome 118. The cap 178 generally includes a first arm 180 and a second arm 182, the second arm 182 extending substantially parallel with the first arm 180. The first and second arms 180, 182 together define an opening 184 for receipt of the forward end 112 of the outer liner 108. The cap 178 also includes a base 186 extending between the first and second arms 180, 182 and defining an inside surface 188 and an outside, or end, surface 190. The first arm 180, the second arm 182, and the base 186 are all formed integrally for the embodiment depicted from a metal material. For example, the first arm 180, the second arm 182, and the base 186 may be formed using a casting process, or alternatively, the opening 184 may be formed between the first and second arms 180, 182 using an extrusion process. Alternatively, however, the cap 178 may be formed of individual arm and base components joined using, e.g., a welding process. Moreover, in certain exemplary embodiments, the cap 178 may be a single annular component, or alternatively the cap 178 may be formed of a plurality of components arrange circumferentially over the forward end 112 of the outer liner 108. Further, in still other embodiments, the cap 178 may be formed partially or completely of a suitable CMC material.

Referring still to the embodiment depicted, the first and second arms 180, 182 of the cap 178 extend past the mounting assemblies 144. Accordingly, the first arm 180 and the second arm 182 may each define one or more openings for receiving at least a portion of one or more of the mounting assemblies 144 mounting the forward end 112 of the outer liner 108 to the outer dome 118. For example, the first and second arms 180, 182 depicted may each define one or more openings allowing the metal grommet 176, the bushing 168, and the pin 166 of each mounting assembly 144 to extend therethrough.

For the exemplary embodiment depicted, the base 186 of the cap 178 and the forward end 112 of the outer liner 108 define a gap 192 therebetween with a resilient member 194 positioned therein (i.e., adjacent to the inside surface 188 of the base 186 and the forward end 112 of the outer liner 108). The purpose of the resilient member 194 is twofold. First, the resilient member 194 is configured to form a seal between the inside surface 188 of the base 186 of the cap 178 and the forward end 112 of the outer liner 108. Second, the resilient member 194 is configured to press the base 186 of the cap 178 away from the forward end 112 of the liner 108 such that the end surface 190 of the cap 178 is pressed against the enclosed surface 120 of the outer dome 118. Accordingly, such a configuration may allow the cap 178 to form a substantially airtight seal between the forward end 112 of the outer liner 108 and the outer dome 118.

In certain exemplary embodiments, the resilient member 194 may be a rope seal, such as a braided rope seal having a silicone core. Alternatively, however, in other exemplary embodiments, any other suitable resilient member 194 may be provided for pressing the base 186 of the cap 178 away from the forward end of the liner and forming a seal between the inside surface 188 of the base 186 of the cap 178 and the forward end 112 of the liner 108. For example, in other exemplary embodiments, the resilient member 194 may be a W-seal, a wire seal, or any other suitable seal.

Moreover, referring back to FIG. 3, it should be appreciated that the forward end 106 of the inner liner 102 may be attached to the inner dome 116 in substantially the same manner that the forward end 112 of the outer liner 108 is attached to the outer dome 118. For example, a cap (similar to the cap 178 positioned over the forward end 112 of the outer liner 108) may be positioned over the forward end 106 of the inner liner 102 and at least partially within the slot 122 of the inner dome 116. An end surface of such cap may contact the enclosed surface 120 of the inner dome 116 such that a substantially airtight seal is formed between the end surface of such cap and the enclosed surface 120 of the inner dome 116. Further, such a cap may define a gap (similar to the gap 192 defined between the inner surface 188 of the cap 178 and the forward end 112 of the outer liner 108) between an inner surface and the forward end 106 of the inner liner 102 with a suitable resilient member 194 positioned therein.

A combustor in accordance with an exemplary embodiment of the present disclosure assembly having a cap positioned over an inner liner or an outer liner may be capable of controlling an airflow from a relatively high pressure plenum or a relatively high pressure inner passage into a combustion chamber through an attachment point between the inner or outer liners and an inner or outer dome. Moreover, such a combustor assembly may be capable of controlling an airflow from a relatively high pressure plenum or a relatively high pressure inner passage into a combustion chamber through an attachment point between the inner or outer liners and an inner or outer dome while still accommodating a relative thermal expansion between the inner or outer liners and inner or outer domes.

Figure 5:
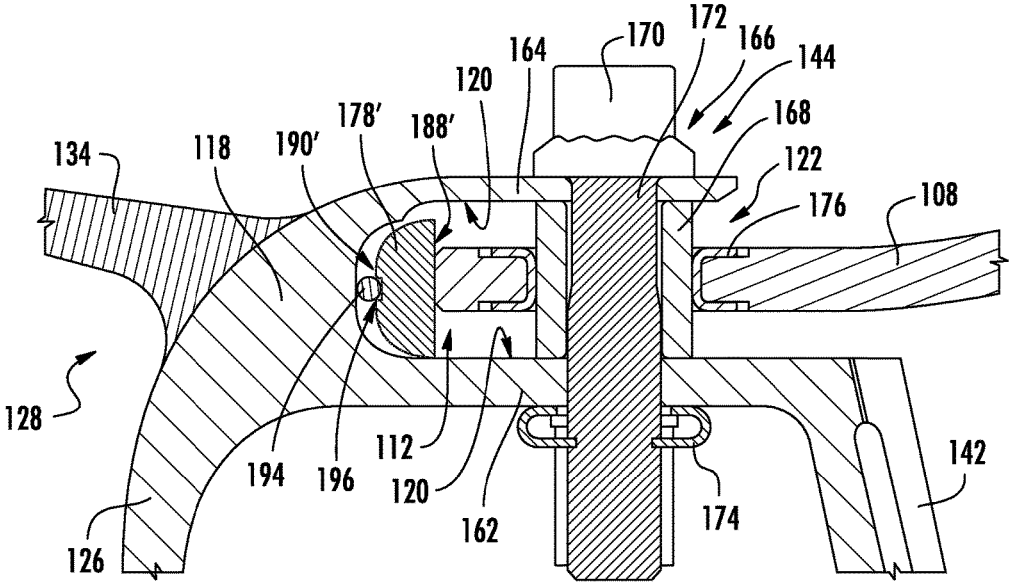
FIG. 5 is a close-up, cross-sectional view of an attachment point of a combustor assembly in accordance with another exemplary embodiment of the present disclosure, where a forward end of an outer liner is attached to an outer annular dome.

Reference will now be made to FIG. 5. FIG. 5 provides a close-up, cross-sectional view of a combustor assembly 100 in accordance with another exemplary embodiment of the present disclosure. More particularly, FIG. 5 provides a close-up, cross-sectional view of an attachment point where a forward end 112 of an outer liner 108 is attached to an outer annular dome 118. The exemplary combustor assembly 100 of FIG. 5 may be configured in substantially the same manner as the exemplary combustor assembly 100 described above with reference to FIGS. 2 through 4. Accordingly, the same or similar numbering refers to the same or similar components.

As is depicted, the forward end 112 of the outer liner 108 is positioned within a slot 122 defined by an enclosed surface 120 of the outer annular dome 118. A mounting assembly 144 attaches the forward end 112 of the outer liner 108 to the outer annular dome 118. Additionally, the exemplary combustor assembly 100 depicted in FIG. 5 includes a cap 178' positioned at the forward end 112 of the outer liner 108 and at least partially within the slot 122 defined by the enclosed surface 120 of the annular dome 118. The exemplary cap 178' depicted defines an inside surface 188' configured to contact the forward end 112 of the liner 108 and an end surface 190' positioned opposite the inside surface 188'. The end surface 190' defines a notch 196. A resilient member 194 is positioned adjacent to the end surface 190' of the cap 178', within the notch 196. The cap 178' and resilient member 194 are configured to form a seal between the end surface 190' of the cap 178' and the enclosed surface 120 of the annular dome 118, as well as between the inside surface 188' of the cap 178' and the forward end 112 of the liner 108. More particularly, the resilient member 194 is configured to form a seal between the enclosed surface 120 of the annular dome 118 and the end surface 190' of the cap 178', and is also configured to press the cap 178' against the forward end 112 of the outer liner 108, such that the inside surface 188' of the cap 178' contacts the forward end 112 of the outer liner 108. Such a configuration may allow for the exemplary combustor assembly 100 depicted to control an airflow through the attachment point between the outer annular dome 118 and the outer liner 108 as the outer annular dome 118 thermally expands relative to the outer liner 108 along the radial direction R.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor assembly for a gas turbine engine defining an axial direction, the combustor assembly comprising:

a liner at least partially defining a combustion chamber and extending between an aft end and a forward end generally along the axial direction;

an annular dome including an enclosed surface defining a slot for receipt of the forward end of the liner;

a cap positioned at the forward end of the liner and at least partially positioned within the slot defined by the enclosed surface of the annular dome, the cap including a first surface configured to contact at least one of the enclosed surface of the annular dome or the forward end of the liner, wherein the cap is positioned over the forward end of the liner, and wherein the first surface of the cap is an end surface configured to contact the enclosed surface of the annular dome; and a resilient member positioned in a gap defined between the cap and the forward end of the liner, wherein the resilient member is configured to form a first seal between the cap and the forward end of the liner, and wherein the resilient member is also configured to press the first surface of the cap against the enclosed surface of the annular dome to form a second seal between the cap and the enclosed surface, wherein the cap further comprises:

a first arm extending axially;

a second arm extending substantially parallel with the first arm; and a base extending radially between the first arm and second arm and defining an inside surface and an outside surface, wherein the first and second arms together define the radially inner and radially outer boundaries of the gap in which the resilient member is positioned, and wherein the first arm and the second arm each define one or more cap openings for receiving a mounting assembly for mounting the forward end of the liner to the annular dome.

2. The combustor assembly of claim 1, wherein the resilient member is a rope seal including a silicone core.

3. The combustor assembly of claim 1, wherein the liner is an outer liner and wherein the annular dome is an outer annular dome.

4. The combustor assembly of claim 1, wherein the liner is an inner liner and wherein the annular dome is an inner annular dome.

5. The combustor assembly of claim 2, wherein the liner is comprised of a ceramic matrix composite material.

6. The combustor assembly of claim 5, wherein the annular dome is comprised of a metal material.

7. The combustor assembly of claim 5, wherein the annular dome includes a base plate and a yoke, the base plate and the yoke extending parallel to one another, the enclosed surface of the annular dome including a second surface of the base plate and a third surface of the yoke.

8. The combustor assembly of claim 7, further comprising:

the mounting assembly extending through the yoke of the annular dome, through the forward end of the liner, and through the base plate of the annular dome, wherein the mounting assembly attaches the liner to the annular dome.

9. The combustor assembly of claim 8, wherein the mounting assembly includes a pin and a bushing, wherein the pin extends through the yoke, the forward end of the liner, and the base plate, and wherein the bushing is positioned around the pin within the slot and pressed between the yoke and the base plate.

10. The combustor assembly of claim 1, wherein the first arm, the second arm, and the base are all formed integrally of a metal material or a ceramic matrix composite (CMC) material.

11. The combustor assembly of claim 1, further comprising a plurality of fuel air mixers spaced along a circumferential direction within the annular dome.

12. The combustor assembly of claim 9, further comprising a metal grommet positioned around the bushing within a liner opening defined in the forward end of the liner.

13. A gas turbine engine defining an axial direction, the gas turbine engine comprising:

a compressor section;

a turbine section mechanically coupled to the compressor section through a shaft; and a combustor assembly disposed between the compressor section and the turbine section, the combustor assembly including a liner at least partially defining a combustion chamber and extending between an aft end and a forward end generally along the axial direction;

an annular dome including an enclosed surface defining a slot for receipt of the forward end of the liner;

a cap positioned at the forward end of the liner and at least partially positioned within the slot defined by the enclosed surface of the annular dome, the cap including a first surface configured to contact at least one of the enclosed surface of the annular dome or the forward end of the liner, wherein the cap is positioned over the forward end of the liner, and wherein the first surface of the cap is an end surface configured to contact the enclosed surface of the annular dome; and a resilient member positioned in a gap defined between the cap and the forward end of the liner, wherein the resilient member is configured to form a first seal between the cap and the forward end of the liner, and wherein the resilient member is also configured to press the first surface of the cap against the enclosed surface of the annular dome to form a second seal between the cap and the enclosed surface, wherein the cap further comprises:

a first arm extending axially;

a second arm extending substantially parallel with the first arm; and a base extending radially between the first arm and second arm and defining an inside surface and an outside surface, wherein the first and second arms together define the radially inner and radially outer boundaries of the gap in which the resilient member is positioned, and wherein the first arm and the second arm each define one or more cap openings for receiving a mounting assembly for mounting the forward end of the liner to the annular dome.

* * * * *